United States Patent [19]

Amsdill et al.

[11] 4,375,757

[45] Mar. 8, 1983

[54] INLET WATER TEMPERATURE CONTROL FOR ICE MAKING MACHINE

[75] Inventors: Mark F. Amsdill, Dexter; James M. Allmendinger, Ypsilanti; Harry Lender, Lakeland, all of Mich.

[73] Assignees: William A. Stoll; William J. Moosbrugger, both of Ann Arbor, Mich. ; part interest to each

[21] Appl. No.: 284,459

[22] Filed: Jul. 17, 1981

[51] Int. Cl.[3] ..... F25C 1/14

[52] U.S. Cl. ..... 62/354

[58] Field of Search ..... 62/354, 71

[56] References Cited

U.S. PATENT DOCUMENTS

| | | | |
|---|---|---|---|
| 2,629,229 | 2/1953 | Hull | 62/7 |
| 2,685,175 | 8/1954 | Hull | 62/7 |
| 2,912,831 | 11/1959 | Palmatier | 62/113 |
| 3,159,007 | 12/1964 | Rahauser et al. | 62/69 |
| 3,367,127 | 2/1968 | Walker | 62/137 |
| 3,803,869 | 4/1974 | Neumann et al. | 62/320 |
| 3,805,101 | 4/1974 | Purman | 310/54 |
| 3,870,942 | 3/1975 | Boese et al. | 320/2 |
| 4,020,642 | 5/1977 | Haselden et al. | 62/84 |
| 4,020,644 | 5/1977 | True, Jr. et al. | 62/340 |
| 4,075,863 | 2/1978 | Wilson | 62/138 |
| 4,201,061 | 5/1980 | Hefferman | 62/98 |

*Primary Examiner*—William E. Tapolcai

*Attorney, Agent, or Firm*—James M. Deimen

[57] ABSTRACT

The invention comprises an improvement to a freezing plate type continuous ice making machine. Such machines continuously form chunks of hard ice without alternating freezing and harvesting cycles. The improvement comprises apparatus to control the temperature of the inlet water supplied to the freezing plate. The control is accomplished by a thermal, electrical and mechanical feedback loop that automatically increases the water inlet temperature as a result of excessive ice buildup on the freezing plate. In theory the control operates as a negative feedback loop actuated by excessive ice buildup on the freezing plate. As a result the inlet water temperature is prevented from falling below the proper temperature for continuous smooth operation of the ice making machine.

The apparatus of the loop comprises the mechanical and electrical drive mechanism for the ice cutter or scraper and an inlet water heat exchanger in thermal communication with the electric drive motor for the ice cutter.

6 Claims, 3 Drawing Figures

INLET WATER TEMPERATURE CONTROL FOR ICE MAKING MACHINE

BACKGROUND OF THE INVENTION

The field of the invention pertains to machines that continuously produce chunks of hard ice and, in particular, to machines such as that disclosed in U.S. Pat. No. 3,803,869. Such machines are extensively used to supply ice for the restaurant business and for ice packs in treating athletic injuries.

From extensive experience in servicing such machines, applicant's have found them subject to breakdown from excessive ice buildup on the freezing plate. The excessive ice buildup is typically caused by an excessively low inlet water temperature to the reservoir that supplies a uniform level of water to the freezing plate of the ice making machine. The excessively low inlet water temperature arises from fluctuations in the building or utility water supply to the ice making machine.

U.S. Pat. Nos. 3,367,127 and 4,020,644 disclose means for heating the inlet water supply to the automatic ice forming element of a refrigeration apparatus. The heating means are effectively uncontrolled and apply heat to the inlet water regardless of need.

U.S. Pat. Nos. 2,629,229 and 2,685,175 illustrate means for cooling beverages that include a motor driven stirrer for the beverage and a refrigerant condenser fan on the stirrer motor. The stirrer motor is cooled by the fan attached thereto.

U.S. Pat. Nos. 3,805,101 and 4,020,642 illustrate means for cooling the refrigeration compressor motor by passing the refrigerant directly through the motor windings.

U.S. Pat. No. 3,159,007 discloses a condenser fan motor that also drives the impellers for scraping and mixing inside a frozen confection machine. The load on the fan motor and heat rejected by the fan motor are partially a function of the frozen consistency of the confection forced through the mixing chamber of the machine. The above devices, however, are not directed to controlling excessive ice buildup in a continuous ice making machine.

SUMMARY OF THE INVENTION

The invention comprises an improvement to a freezing plate type ice making machine such as that disclosed in U.S. Pat. No. 3,803,869. Such machines continuously form chunks of hard ice by scraping a thin layer of slush ice from a circular freezing plate and then comprising the slush ice to remove the water and form hard ice chunks. The rate of ice formation on the freezing plate is partly a function of the temperature of the inlet water flooded onto the plate surface from an adjacent reservoir. An excessively low inlet water temperature causes an excessive buildup of ice to form on the plate and in turn causes the electric motor driven ice scrapers to slow and overheat the motor or to physically damage the ice making apparatus.

The improvement comprises apparatus to control the temperature of the inlet water supplied to the reservoir and freezing plate. The control is accomplished by utilizing the heat rejected from the electric drive motor for the scrapers to preheat the inlet water to the reservoir. The heat rejected by the electric drive motor is partially a function of the mechanical load on the motor which in turn is a function of the ice thickness and hardness on the freezing plate. As the ice buildup becomes excessive due to excessively cold inlet water, the load on the drive motor substantially increases and the motor rejects an increasing amount of heat. This excess heat in turn increases the preheat of the inlet water thereby decreasing the ice buildup on the freezing plate.

The apparatus, including an inlet water heat exchanger in thermal communication with the electric drive motor, provides a negative feedback loop control actuated by excessive ice buildup on the freezing plate. The inlet water heat exchanger is of extremely inexpensive construction and very easily retrofitted to existing ice making machines. The heat exchanger utilizes waste heat from the motor thereby eliminating any need for additional electric power to heat the inlet water.

DESCRIPTION OF THE PREFERRED EMBODIMENT

Figure 1:
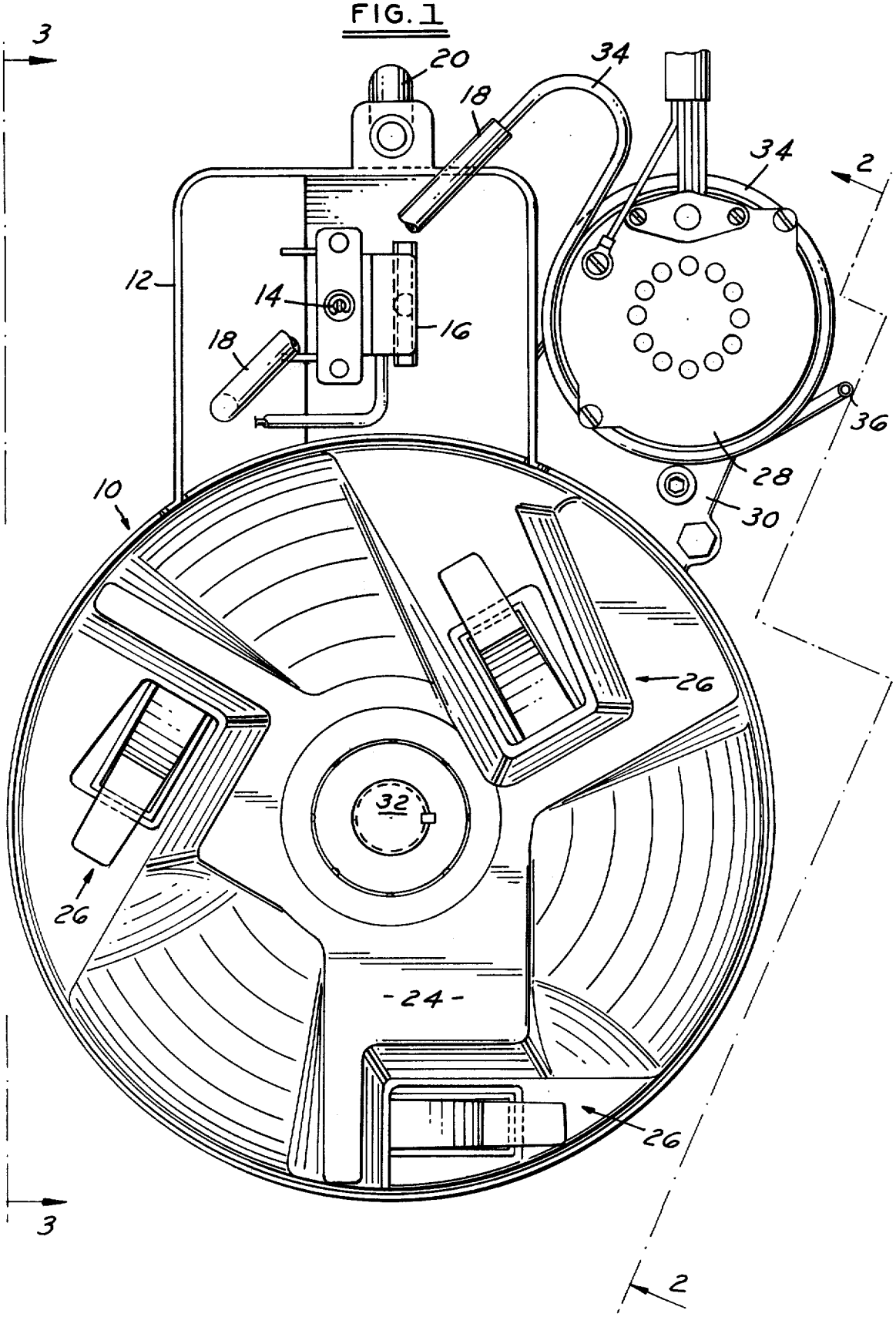
FIG. 1 is a top view of the improved ice making machine and control.
Figure 2:
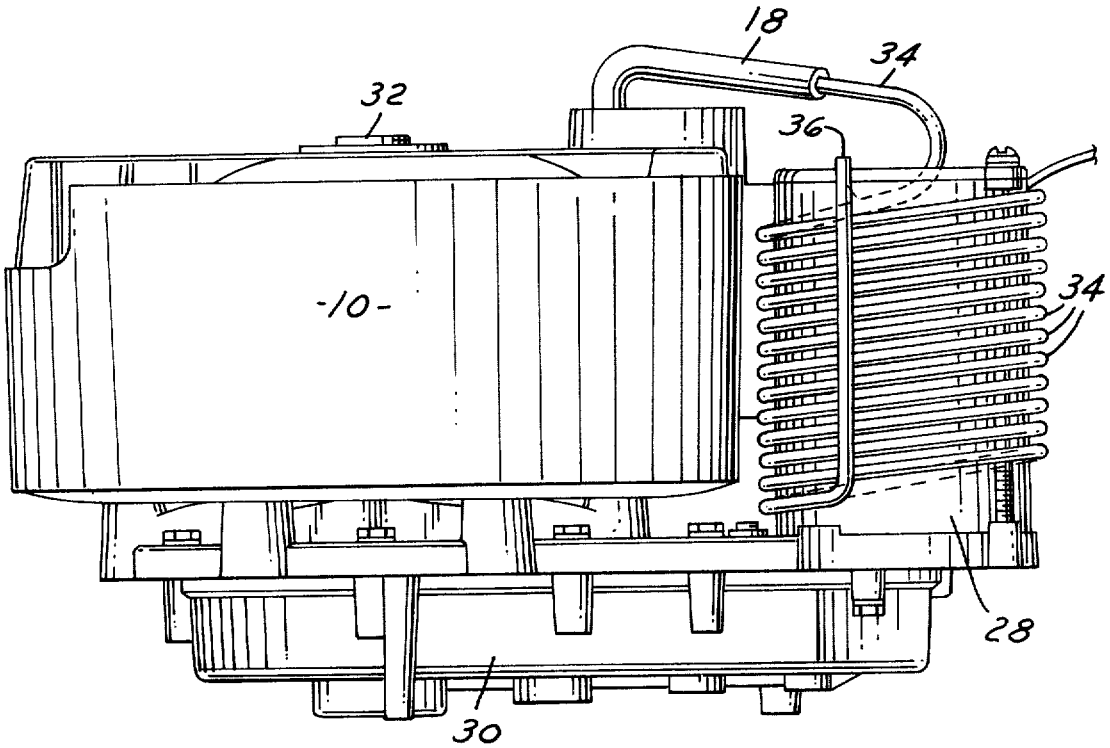
FIG. 2 is a right side view of the ice making machine and control taken along the line 2—2 in FIG. 1; and, FIG. 3 is a left side view of the ice making machine and control taken along the line 3—3 in FIG. 1.
Figure 3:
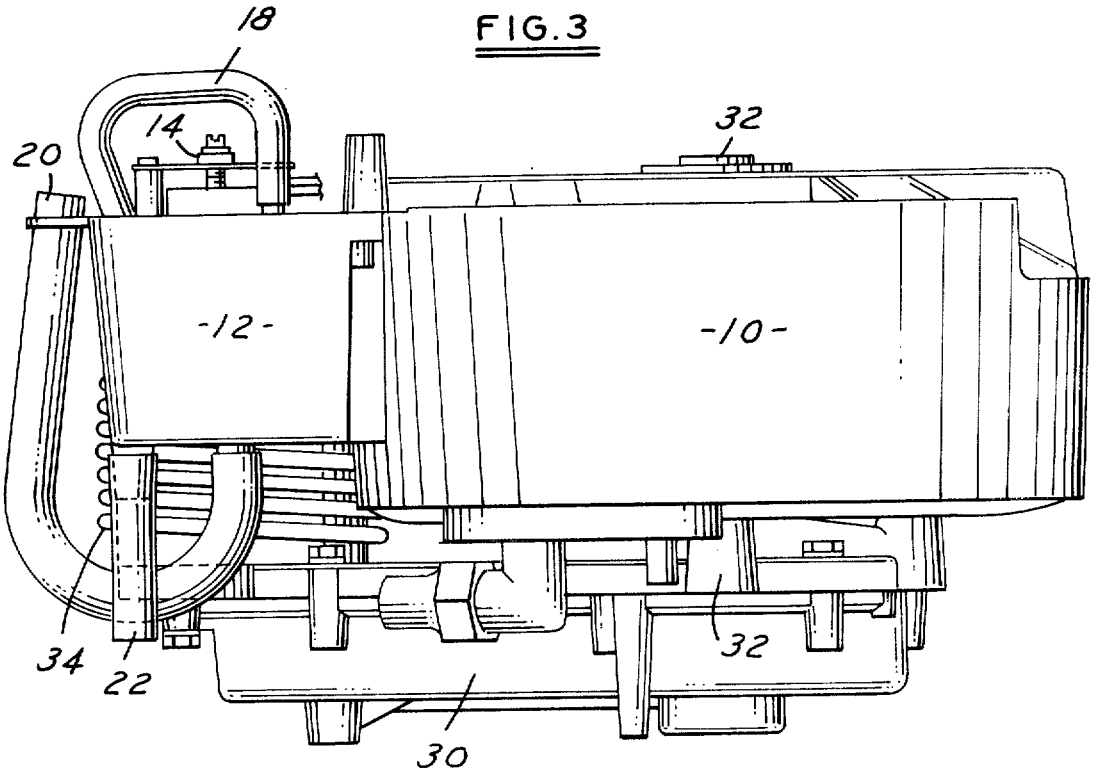

In FIGS. 1, 2 and 3 the ice making or freezing hopper of bowl 10 and associated apparatus to which the improvement applies is shown. The complete freezing bowl operation and apparatus will only be described briefly in this disclosure, reference being made here to the disclosure in U.S. Pat. No. 3,803,869. It is to be understood that while the disclosure below is directed to an improvement of one specific type of ice making machine, the invention is applicable to other electromechanical ice making machines wherein excessive ice buildup causes overloading of the machine and overheating of the drive motor.

Attached to the bowl 10 is a water reservoir 12 in communication with the interior of the bowl. Within the reservoir 12 is a float (not shown) suspended from a height adjustment 14 and microswitch 16. The float and microswitch control addition of makeup water to the reservoir by actuating an inlet water control valve (not shown). The inlet water enters the reservoir 12 through the hose 18 at the top. Extending from the bottom of the reservoir 12 is a manual drain hose 20 and an over flow drain 22.

Within the bowl 10 is a rotatable cover plate 24 having three mechanisms generally denoted by 26 for scraping and compressing slush ice into hard ice chunks. Under the cover 24 lies a stationary flat freezing plate (not shown) cooled by refrigerant from underneath. The reservoir 12 provides a constant level or depth of water on the freezing plate. As ice crystals form on the freezing plate underneath the cover 24, the scraper mechanisms 26 continuously rotate with the cover 24 to scrape and compress the ice crystals into hard ice chunks.

The cover 24 and scraper mechanisms 26 are rotated by an electro-mechanical drive train comprising an electric motor 28, a reduction gear mechanical drive enclosed within the cover 30 and a vertical shaft 32 located in the center of the bowl 10 and drivingly connected to the cover 24. The electric motor 28 provides the motive power for scraping, compressing and breaking into pieces the hard chunk ice produced.

Wrapped about the electric motor 28 is a copper tube 34. The copper tube 34 outlet is connected to hose 18 and the copper tube inlet 36 is connected to the inlet water supply and valve controlled by the microswitch 16. The copper tube 34 is wound into a coil about the electric motor 28 to provide good thermal contact with the motor. The copper tube 34 thereby provides effective cooling for the motor 28 and heating of the inlet water to the reservoir 12. In normal operation of the machine approximately a 20° F. boost is applied to the inlet water.

Tests run on two different models of the ice making machines before and after installation of the copper tube heat exchanger are summarized as follows: Before installation of the heat exchanger and with an inlet water temperature of 44° F., the electric drive motor temperature was in excess of 170° F., the motor overload relay tripped every 2 to 6 hours of operation and the hopper or bowl split frequently requiring replacement. After installation of the heat exchanger, the water inlet temperature to the reservoir was maintained above 64° F. despite much lower supply temperatures, the motor temperature remained between 80° F. and 100° F. and motor overload trips and split hoppers were eliminated.

A 3/16" diameter by 18' length of copper tubing was wrapped about the motor for the tests and the retrofit installations to date, however, the tubing length and size may be varied to adjust the water temperature boost and motor heat load rejection desired.

We claim:

1. In an ice making machine comprising means for continuously cooling water to form ice crystals, means for supplying makeup water to the continuous cooling means, means for removing the ice crystals from the water and continuous cooling means, said removal means including electro-mechanical drive means to energize the ice crystal removal means, the improvement comprising in combination an electric motor incorporated in the electro-mechanical drive means and a heat exchanger in thermal communication with the electric motor, the supply makeup water being passed through the heat exchanger.

2. The ice making machine of claim 1 wherein the heat exchanger comprises a tubular coil wrapped about the electric motor.

3. An inlet supply water temperature electro-mechanical feedback control for an ice making machine, the feedback control comprising in combination a mechanical ice crystal scraper in the machine, a mechanical drive means to actuate the ice crystal scraper, an electric drive motor energizing the mechanical drive means and ice crystal scraper, and, a heat exchanger in thermal communication with the electric drive motor and in fluid communication with the inlet supply water to the ice making machine, the heat exchanger comprising a tubular coil wrapped about the electric drive motor and the inlet water supply passing through the tubular coil, such that increasing ice crystal buildup causes increased mechanical loading of the ice crystal scraper, mechanical drive means and electric drive motor, the increased mechanical loading of the electric drive motor causing an increase in motor temperature thereby heating the supply water to the ice making machine and reducing the ice buildup that resists the ice crystal scraper.

4. An inlet supply temperature feedback control for an ice making machine, the feedback control comprising in combination an electric drive motor mechanically connected to ice crystal gathering means such that the motor operating temperature is a function of the force required to gather the ice crystals and heat transfer means in thermal communication with the electric motor and in field communication with the inlet water supply to the ice making machine, said heat transfer means comprising a tubular coil wrapped about the electric motor.

5. The inlet water supply temperature control of claim 4 wherein said tubular coil is attached to the electric motor.

6. The inlet water supply temperature control of claim 4 including a supply water reservoir adjacent the ice making and gathering means of the ice making machine, said tubular coil being connected to said reservoir.

* * * * *